US009267683B2

(12) United States Patent
Ferguson et al.

(10) Patent No.: US 9,267,683 B2
(45) Date of Patent: Feb. 23, 2016

(54) COKE TREATMENT PROCESS AND SYSTEM TO MINIMIZE $NO_X$ EMISSIONS AND MINIMIZE CATALYST VOLUME

(71) Applicant: Honeywell International Inc., Morristown, NJ (US)

(72) Inventors: Christopher Ferguson, Tulsa, OK (US); Subhash Tiwari, Tulsa, OK (US); Matthew Martin, Tulsa, OK (US)

(73) Assignee: HONEYWELL INTERNATIONAL, INC., Morris Plains, NJ (US)

( * ) Notice: Subject to any disclaimer, the term of this patent is extended or adjusted under 35 U.S.C. 154(b) by 557 days.

(21) Appl. No.: 13/832,872

(22) Filed: Mar. 15, 2013

(65) Prior Publication Data

US 2015/0013576 A1 Jan. 15, 2015

(51) Int. Cl.
*F23G 7/00* (2006.01)

(52) U.S. Cl.
CPC ..... *F23G 7/00* (2013.01); *F23G 2209/30* (2013.01)

(58) Field of Classification Search
CPC ..... C10J 3/00; C10G 9/00; C10G 9/36; C10G 9/30
USPC ..... 208/130, 127, 125, 48
See application file for complete search history.

(56) References Cited

U.S. PATENT DOCUMENTS

| | | | |
|---|---|---|---|
| 1,049,667 | A | 1/1913 | Burton |
| 5,914,091 | A | 6/1999 | Holst et al. |
| 6,003,305 | A | 12/1999 | Martin et al. |
| 6,282,371 | B1 | 8/2001 | Martin et al. |
| 6,755,962 | B2 | 6/2004 | Banerjee |
| 7,682,586 | B2 | 3/2010 | Harold et al. |

*Primary Examiner* — Matthew Merkling

(57) ABSTRACT

A method and a process to treat coke generated from a process application. The method includes the steps of recovering a mixture of coke particles and water or steam removed from at least one process application vessel. The mixture is directed to a cyclonic separator utilizing centrifugal force and gravity. Water is separated from the mixture in the cyclonic separator. Coke particles are separated from the mixture in the cyclonic separator and are directed to a thermal oxidizer. Coke particles are oxidized and gasified in the thermal oxidizer to produce gas and reduced particulate matter. The gas and reduced particulate matter are thereafter directed to a burner in the process application vessel.

5 Claims, 2 Drawing Sheets

COKE TREATMENT PROCESS AND SYSTEM TO MINIMIZE $NO_X$ EMISSIONS AND MINIMIZE CATALYST VOLUME

BACKGROUND OF THE INVENTION

1. Field of the Invention

The present invention is directed to a process and a system to treat coke particles generated in process and heating applications while minimizing $NO_x$ emissions and minimizing required SCR catalyst volume.

2. Description of the Related Art

In many process and heating applications, cracking is utilized whereby heavy organic molecules, such as hydrocarbons, are broken down into lighter molecules, such as light hydrocarbons. An example of such a process or heating application would be an ethylene cracking furnace. The cracking process may be initiated by heat, by catalysts, or by solvents. An early thermal cracking process may be observed in Burton (U.S. Pat. No. 1,049,667) issued in 1913 titled "Manufacture of Gasolene".

The cracking process often results in a slow deposition of coke, a form of carbon, on the reactor or vessel walls and/or on a series of serpentine tubes within the vessel or reactor. Over time, this degrades the efficiency of the process. Accordingly, a de-coking procedure is periodically utilized. The furnace or vessel is initially isolated or taken off-line from the normal process application. The accumulated coke may then be removed in a number of ways. Coke may be mechanically removed, such as by scraping or chipping. Alternatively, a fluid of hot water and/or steam is passed into and through the vessel or tubes. The steam and water are utilized to unloosen and remove the coke particles. The coke particles are thereafter removed in this manner and the vessel or furnace is then put back in to use.

The steam and/or water and coke or coke slurry must thereafter be dealt with. Some forms of coke may have value and may be reused, such as for fuel. So-called green coke may be used as fuel in refineries, cement kilns and steel industries. Other forms of coke may be used in battery terminals or other uses. Much of the coke, however, has little value; for example, it is sometimes used in filler for roadway construction and maintenance.

A later prior art development is shown in a simplified diagram in FIG. 1. A furnace, reactor or vessel 10 includes a series of internal serpentine tubes 12. A burner 14 supplied with fuel, such as natural gas, from a fuel line 16 provides heat. A portion of the heat generated in the furnace, reactor or vessel may be captured in a heat recovery unit 20. The mixture of slurry of steam and/or water and coke is removed from the furnace via a port 22. The coke particles removed from the vessel or furnace are slowly reintroduced back in to the burner 14 of the furnace via a line 24. The water and steam would be vaporized and a portion of the coke particles would be oxidized and consumed. A negative outcome of this procedure is that it generates increased $NO_x$ as emissions from the furnace 10 at an exhaust 28 depicted by arrow 26. Combustion of fossil fuels is known to generate some level of $NO_x$ emissions, which includes nitric oxide (NO) and nitrogen dioxide ($NO_2$).

$NO_x$ may be controlled in a number of ways. Martin et al. (U.S. Pat. No. 6,003,305) illustrates an example of a method of reducing $NO_x$ products of incomplete combustion in an internal combustion engine. A selective catalytic reduction system (SCR) is disposed downstream of a flameless thermal oxidizer. SCR systems catalytically reduce $NO_x$ emissions to nitrogen and water using a catalyst, in conjunction with ammonia ($NH_3$).

Harold et al. (U.S. Pat. No. 7,682,586) discloses an example of treatment of nitrogen oxides ($NO_x$) in combustion flue gas with selective catalytic reduction (SCR) using ammonia and urea as reducing agents.

FIG. 2 illustrates a simplified diagram of a later prior art development following FIG. 1. A vessel, reactor or furnace 30 includes a series of internal serpentine tubes 32. A burner 34 supplied with fuel, such as natural gas, from a fuel line 36 provides heat. A portion of heat generated in the vessel or furnace may be captured in a heat recovery unit 38. The mixture or slurry of steam and/or water and coke is removed from the furnace via a port 44. The coke particles removed from the vessel or furnace are slowly introduced back in to the burner 34 via a line 46.

A selective catalytic reducer (SCR) 40 is added near the exhaust 42 of the furnace shown by arrow 48. A chosen catalyst, such as those including ammonia ($NH_3$), would be utilized on a physical support or block having a pattern, such a honeycomb pattern. The SCR system 40 would serve to reduce the $NO_x$ emissions. In high dust situations, such as coal dust or coke particulate dust, larger SCR blocks with larger openings are required. A higher catalyst volume would be required per pound of $NO_x$ that would be treated. In some cases, two to three times the volume of catalyst would be required. This increases the size, the complexity, and the cost of the overall furnace assembly.

Assignee's prior patent, Wirt et al. (U.S. Pat. No. 8,017,084) discloses an example of a selective catalytic reduction system for heat recovery systems and fired heaters.

There remains a need to develop a process and a system to treat the coke by-products removed from a furnace, reactor or vessel efficiently.

There remains a need to develop a process and system to treat coke by-products directed to the goal of minimizing the volume of SCR required while maximizing the efficiency.

SUMMARY OF THE INVENTION

The present invention is directed to a method and system to treat coke particles generated in process and heating applications in order to minimize $NO_x$ emissions and to minimize catalyst volume. At least one furnace, reactor or vessel is provided. Each vessel includes a burner which is supplied with fuel, such as natural gas, from an incoming fuel line.

A reduced volume selected catalytic reduction (SCR) system may be utilized at the exhaust of the vessel.

When the vessel is taken out of service, water and/or steam is injected to unloosen coke particles. The resulting slurry mixture of coke particles and water and/or steam is then delivered to a cyclonic separator utilizing centrifugal force and gravity to separate the water from the coke particles.

The water droplets and/or steam are thereafter removed from the cyclonic separator. The coke particles separated from the slurry mixture in the cyclonic separator are thereafter directed to a thermal oxidizer which gasifies or oxidizes solid particles to produce gas and reduced particulate matter.

The gas and reduced particulate matter output from the thermal oxidizer will be then directed back to one of the vessels.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
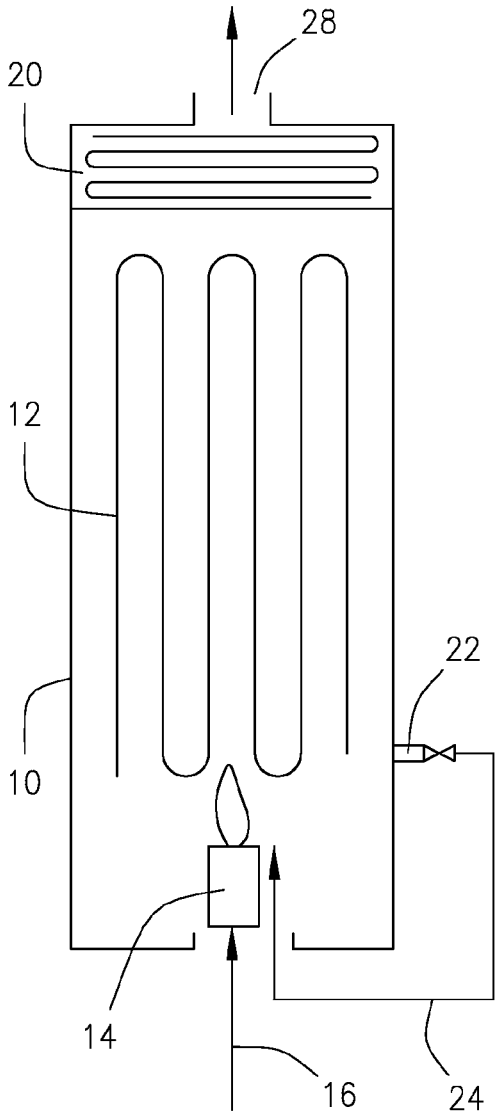
FIG. 1 PRIOR ART
FIG. 1 is a simplified diagrammatic view of a prior art furnace or vessel depicting a procedure for removal of coke particles.
Figure 2:
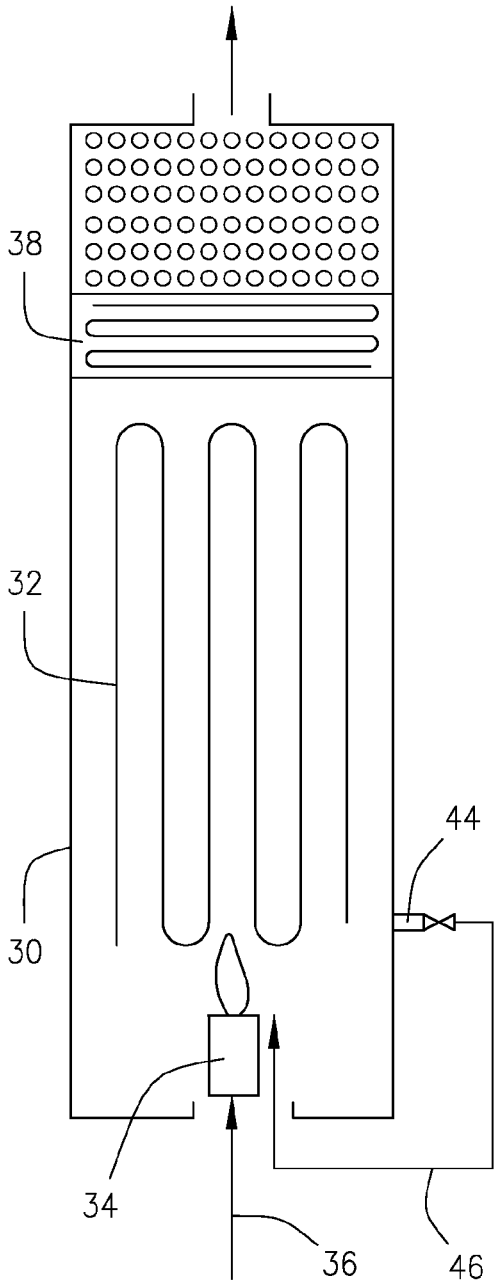
FIG. 2 PRIOR ART
FIG. 2 illustrates a simplified diagrammatic view of an alternate prior art furnace or vessel depicting removal of coke particles.
Figure 3:
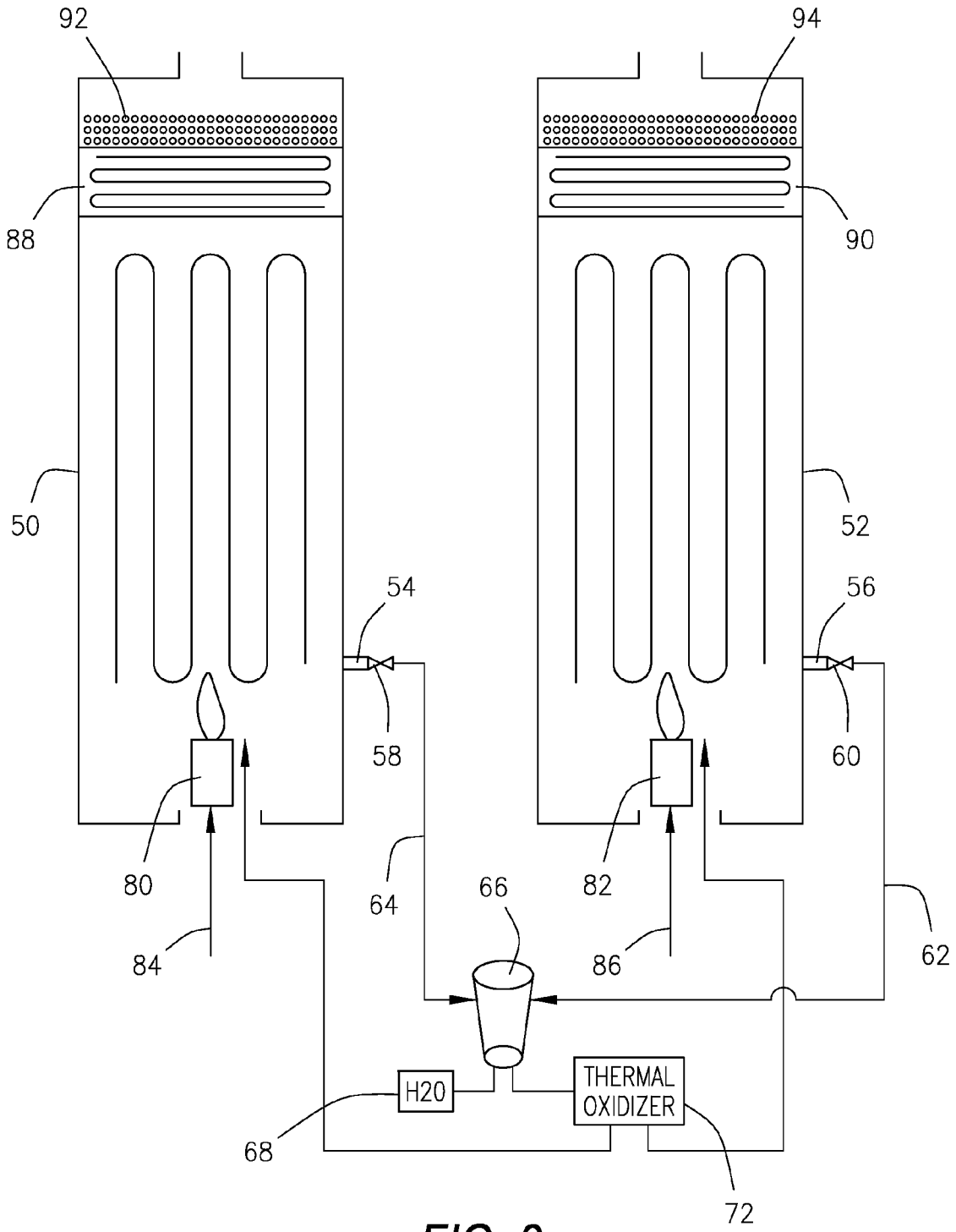
FIG. 3 illustrates a simplified diagrammatic view of a process and system to treat coke particles in order to minimize $NO_x$ emissions and to minimize required catalyst volume in accordance with the present invention.

Referring to the drawings in detail, FIG. 3 illustrates an example of a preferred embodiment of a method and a system to treat coke particles in order to minimize $NO_x$ emissions and to minimize catalyst volume in accordance with the present invention. At least one furnace, reactor or vessel is provided. In the present embodiment, a pair of vessels 50 and 52 are depicted although it will be appreciated that a greater number may be employed. Each vessel 50 and 52 includes a series of internal serpentine tubes 96 and 98. Each vessel 50 and 52 includes a burner 80 and 82, respectively, which is supplied with fuel, such as natural gas, from an incoming fuel line 84 and 86. A portion of the heat which is generated in the vessel 50 or 52 may be captured in an optional heat recovery unit 88 or 90, respectively.

A reduced volume selected catalytic reduction (SCR) system 92 and 94, respectively, may be utilized at the exhaust of the vessels 50 and 52.

Through various valves, one of the vessels 50 or 52 may be taken out of service or placed off-line for de-coking. Water and/or steam is injected and utilized to unloosen the coke particles within the vessel and/or within the serpentine tubes. Thereafter, a port 54 or 56 with a valve 58 and 60 respectively may be opened. A slurry mixture of coke particles and water and/or steam is delivered via lines 62 or 64 to a cyclonic separator 66 utilizing centrifugal force and gravity to separate the water from the coke particles.

The water droplets and/or steam are thereafter removed from the cyclonic separator 66 as depicted by the line 74 and box 68. The coke particles separated from the slurry mixture in the cyclonic separator 66 are thereafter directed to a thermal oxidizer 70 by a line 72. The thermal oxidizer 70 is a vessel with a burner inside which gasifies or oxidizes solid particles. The output from the thermal oxidizer 70 will be gas and reduced particulate matter. Thereafter, the gas and reduced particulate matter will be directed back to one of the vessels 50 or 52 to its burner 80 and 82, respectively.

It will be appreciated from the forgoing that a single cyclonic separator 66 and a single thermal oxidizer 72 configured as set forth herein could serve a number of vessels. For example, if the vessel 50 were taken out of service to remove coke particles, the recovered gas and reduced particulate matter could be directed to the burner 82 of the vessel 52.

The present invention results in significant cost savings by reducing the volume of SCR system required.

Whereas, the present invention has been described in relation to the drawings attached hereto, it should be understood that other and further modifications, apart from those shown or suggested herein, may be made within the spirit and scope of this invention.

What is claimed is:

1. A method to treat coke generated from a process application, which method comprises:
- recovering a mixture of coke particles and water or steam removed from at least one process application vessel;
- directing said mixture to a cyclonic separator utilizing centrifugal force and gravity;
- separating water from said mixture in said cyclonic separator;
- separating coke particles from said mixture in said cyclonic separator;
- directing said coke particles from said cyclonic separator to a thermal oxidizer;
- oxidizing and gasifying said coke particles in said thermal oxidizer to produce gas and reduced particulate matter; and
- directing said gas and reduced particulate matter to said process application vessel.

2. A method to treat coke generated from a process application as set forth in claim 1 including the additional steps of:
- recovering a mixture of coke particles and water or steam removed from a plurality of process application vessels;
- and directing said mixture from said plurality of process application vessels to said cyclonic separator.

3. A method to treat coke generated from a process application as set forth in claim 2 including directing said gas and reduced particulate matter to burners in each of said plurality of process application vessel.

4. A method to treat coke generated from a process application as set forth in claim 1 wherein said process application vessel includes a plurality of tubes and wherein said mixture of coke particles and water or steam are recovered from within said tubes.

5. A method to treat coke generated from a process application as set forth in claim 4 wherein said plurality of tubes in said process application vessel include a plurality of serpentine tubes.

* * * * *